US005927502A

United States Patent [19]

Hunter

[11] Patent Number: 5,927,502

[45] Date of Patent: Jul. 27, 1999

[54] FOOD AND BEVERAGE CONTAINER CARRIER AND ADVERTISING/ PROMOTIONAL VEHICLE

[76] Inventor: Anthony L. Hunter, P. O. Box 4262, Mission Viejo, Calif. 92690

[21] Appl. No.: 09/038,674

[22] Filed: Mar. 9, 1998

Related U.S. Application Data

[63] Continuation-in-part of application No. 08/745,033, Nov. 7, 1996, Pat. No. 5,738,217

[60] Provisional application No. 60/006,591, Nov. 13, 1995.

[51] Int. Cl.[6] ..... B65D 5/50; B65D 85/62

[52] U.S. Cl. ..... 206/549; 206/194; 206/216; 206/427

[58] Field of Search ..... 206/163, 167, 206/169, 175, 194, 195, 199, 216, 427, 541, 549, 139; 294/87.2

[56] References Cited

U.S. PATENT DOCUMENTS

| | | | |
|---|---|---|---|
| 4,155,502 | 5/1979 | Forte | 206/194 |
| 5,052,552 | 10/1991 | Maroszek | 206/427 |
| 5,484,053 | 1/1996 | Harris | 206/194 |
| 5,765,684 | 6/1998 | Van Dore et al. | 206/427 |
| 5,797,486 | 8/1998 | Picciolo | 206/194 |
| 5,803,264 | 9/1998 | Gersten et al. | 206/194 |

*Primary Examiner*—Paul T. Sewell
*Assistant Examiner*—Luan K. Bui
*Attorney, Agent, or Firm*—Kevin Lynn Wildenstein, Esq.

[57] ABSTRACT

A foldable carrier for transporting a plurality of food or beverage containers, including (a) a handle portion having at least one slot formed therein; (b) a first panel having at least a first elliptical opening therein; (c) a second panel having at least a second elliptical opening therein; (d) a flexible connection between the handle portion and the first and second panels which permits the handle portion to be moved between a position where the handle portion is perpendicular to the first and second panels and a position where the handle portion is substantially parallel with one of the first and second panels; (e) a third panel with third and fourth elliptical openings and resulting in perpendicular alignment between the first and third, and second and fourth elliptical openings, which connects both the first and second cup supporting panels and limits movement of the first panel towards the second panel when food or drink containers are placed in and carried by the first and second openings; and (f) a locking means adapted to engage the handle portion slot in interlocking fashion to allow the locking means, and thus the handle portion, to be supported by at least one container when the container is loaded into the carrier. The carrier may also include a coverable auxiliary food tray which has a bottom portion and side portions, that when used, contacts and is also supported by the top surface of the locking means.

15 Claims, 18 Drawing Sheets

FOOD AND BEVERAGE CONTAINER CARRIER AND ADVERTISING/ PROMOTIONAL VEHICLE

The present invention is a cip of U.S. application Ser. No. 08/745,033, filed Nov. 7, 1996, now U.S. Pat. No. 5,738, 217, and claims benefit of Provisional Appl. No. 60/006,591 filed Nov. 13, 1995.

BACKGROUND OF THE INVENTION

The present invention relates to portable, collapsible carriers for transporting food and beverage containers. The exposed panels of the carrier are intended to be used as advertising/promotional space. Thus, the carrier is also designed to be an advertising and promotional vehicle.

DESCRIPTION OF THE PRIOR ART

In the operation of fast-food carryout at restaurants, stadiums, arenas and other facilities, a number of selected items of food and drink are frequently carried by the patrons. If more than one or two items are to be carried, some type of carrier is typically provided for the patron's convenience. Such a carrier should be inexpensive, readily transportable, compactly stored, and quickly and easily loaded, all without compromising the ability to safely and conveniently carry a number of liquid filled containers. Liquid container carriers for many applications and of various configurations have been disclosed in U.S. Patents to: Sargeant, U.S. Pat. No. 2,759,629; Farrington, U.S. Pat. No. 2,728,484; Weiselberg, U.S. Pat. No. 2,828,047; Katzenmeyer, U.S. Pat. No. 3,565, 323; Lock, U.S. Pat. No. 4,053,099; Cowlishaw, U.S. Pat. No. 1,001,752; Schnorr, U.S. Pat. No. 1,563,443; Flamm, U.S. Pat. No. 2,330,699; Tyson, Jr., U.S. Pat. No. 2,513,762; Clement, et al., U.S. Pat. No. 2,567,054; Siddal, U.S. Pat. No. 2,732,983; and Struble, U.S. Pat. No. 3,744,704. These container carriers are, for the most part, complex, expensive to manufacture and difficult to store and load. Some require relatively rigid and expensive materials for support. Others require a number of time consuming steps for forming the carriers that are performed by the fast-food operator prior to loading. Where these prior art carriers are capable of flat storage, they generally require a considerable amount of setup time to form the folded parts into its operable configuration, and thus, cause delay in fast-food service. On the other hand, where the prior art carriers are preformed, setup time is considerably decreased but storage problems are increased since the completely unfolded and setup carriers require considerably more storage space.

An incomplete unit of the present invention was employed in 1974. This unit was fundamentally defective for several reasons and thus had many disadvantages. First, the unit was not safe, as it incorporated only angled cuts on the edges of the carrier, resulting in an unsafe product for patrons. This unit was especially unsafe when flung as a flying object, as the angled edges acted with sufficient rotational momentum to potentially seriously injure a patron. Second, the weight of the material used to form this unit did not prevent spillage of heavier drink containers. Consequently, heavier drink containers would place excessive weight on the unit resulting in the destruction of the unit. Third, this unit's handle placement was too close to the unit's drink container openings, thereby requiring the fast-food operator to continuously grasp the unit's handle with one hand while he/she loaded additional drink containers into the unit openings with the other hand. As such, the close proximity of the handle portion to the unit drink container openings was net efficient for fast-food loading operations. Fourth, the unit did not incorporate any form of support mechanism for food items, such as an auxiliary tray, which was compatible with the unit. Fifth, the unit's handle was constructed from only two sheets of the material which formed the unit, thereby resulting in a weak and unstable handle portion when the unit was moist or when used to carry heavier drink containers. Sixth, the unit was not designed to accommodate a plurality of various-sized drink cups or similar containers (such as, for example, various-sized popcorn containers).

Accordingly, it is an object of the present invention to provide a bottomless container carrier that is foldable for convenient and efficient transportation and storage, but is readily, quickly and efficiently converted to its operative configuration for rapid and convenient loading.

It is another object of the invention to provide a carrier with a number of exposed and interior panels suitable for advertising and/or promotion.

It is also an object of the present invention to improve the strength and reliability of the carrier to hold drink containers by providing, for each such drink container, a pair of aligned and spaced apart openings, wherein all aligned openings are elliptical, and wherein the major axis of these aligned elliptical openings are rotationally offset by 90°.

It is yet another object of the present invention to provide an auxiliary tray and a mechanism to lock the tray in its operative position to maintain "lift" on the handle of the carrier when a consumer sets the carrier down and releases the handle.

Additionally, it is an object of the present invention to improve the strength and reliability of the carrier to hold heavy drink and food containers by forming the carrier handle with at least three sheets of heavy weighted material.

It is a further object of the present invention to provide a carrier having substantially rounded edges on all exposed edges to improve the safety of the carrier when employed by a fast-food operator or when used by a patron.

Additionally, it is another object of the present invention to provide a carrier with an extended handle portion which allows a fast food operator hands-free loading of drink containers into the carrier openings or food items in the carrier auxiliary tray.

It is yet still another object of the present invention to provide a carrier and auxiliary tray wherein the auxiliary tray and the carrier can be used separately, (i.e., one without the other).

It is also an object of the present invention to provide a carrier and tray adapted to engage a removable means for support, the means for support adapted to sit upon cups which are placed in the carrier, the means for support further adapated to provide further foundation to the tray as the tray sits upon the means for support.

It is a further object of this invention to provide a means for support which engages and interlocks with a carrier retaining one or more cups, the means for support sitting upon the top portion of some of the cups and adapted to hold the carrier in a horizontal position when the cups, and thus the carrier, are placed on an uneven surface.

SUMMARY OF THE INVENTION

A bottomless foldable carrier for transporting a plurality of beverage containers (e.g. drinking cups), including: (a) a handle portion; (b) a first cup supporting panel which has a first upper surface and also includes at least a first opening therein; (c) a second cup supporting panel which has a second upper surface and also includes at least a second opening therein; (d) a flexible connection between the handle portion and the first and second upper surfaces, the connection permitting the handle portion to be moved between a position where the handle portion is perpendicular to the first and second upper surfaces and a position where the handle portion is substantially parallel with one of the first and second upper surfaces; and (e) a third panel, connected to both the first and second cup supporting panels for limiting the movement of the first cup supporting panel towards the second cup supporting panel when beverage containers are placed in and carried by the said first and second openings. The third panel includes at least third and fourth openings, the third opening being in alignment with the first opening, and the fourth opening being aligned with the second opening. Preferably, the first, second, third and fourth openings are elliptical openings, with each elliptical opening having a major axis. The major axis of the first opening is substantially perpendicular to the major axis of the third opening; the major axis of the second opening is substantially perpendicular to the major axis of the fourth opening. The first and second openings are of the same size; the third and fourth openings are of the same size; and the first and second openings are preferably larger than the third and fourth openings. All exposed edges on the carrier are smoothly rounded for safety to patrons. Preferably the handle portion, the first and second cup supporting panels, and third panel are all integral and formed from a single sheet of material. The sheet of material includes one panel at one end, and two panels at the opposite end thereof, which form the three layer handle portion. The sheet of material has only four folds between the three handle panels.

The bottomless foldable container may also include an auxiliary food tray. Such a tray includes a bottom portion and side portions, with the tray bottom portion having an upper surface and a lower-surface and a slot therein adapted to receive the handle portion. When in position, the tray lower surface contacts the tops of the beverage containers received in the first and third and said second and fourth openings. The handle portion includes means for locking said tray into position. The locking device may include a pair of tabs which fold out from the handle portion. Alternately, the locking device includes a pair of notches formed in the edges of the handle portion which engage the flexible tabs adjacent to the tray slot.

Figure 29:
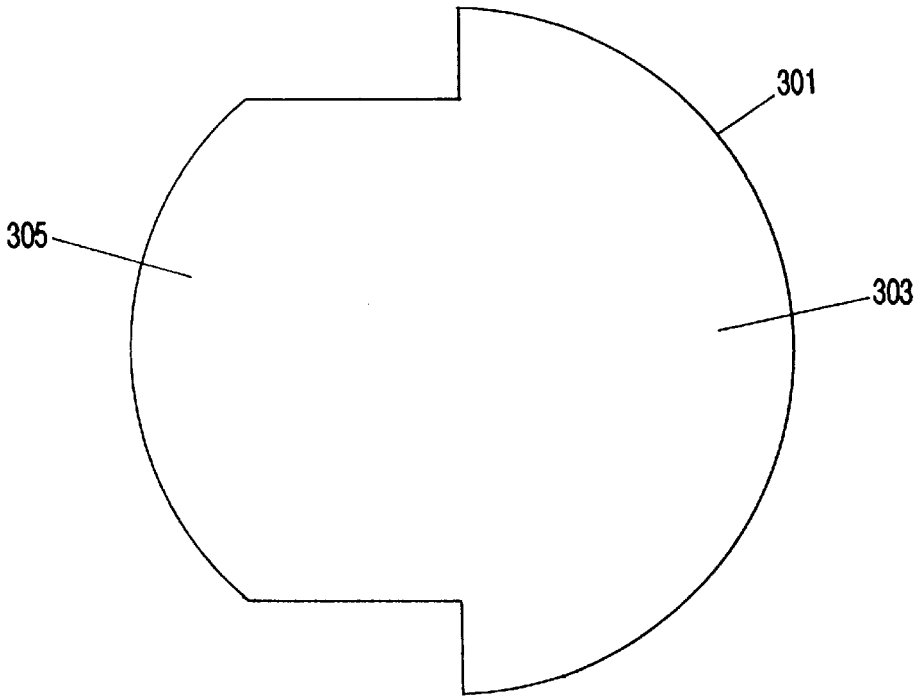
Figure 30:
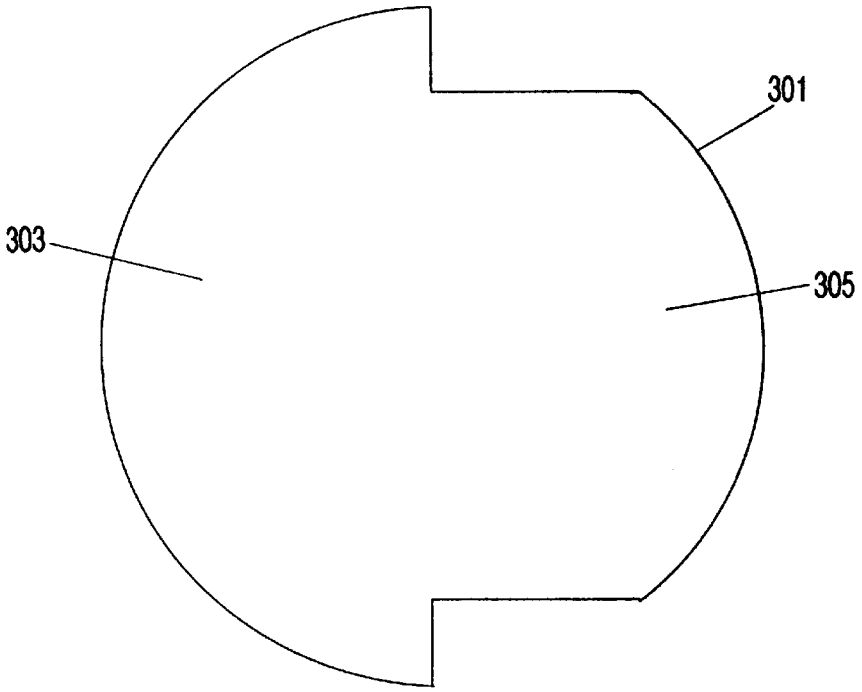
Figure 31:
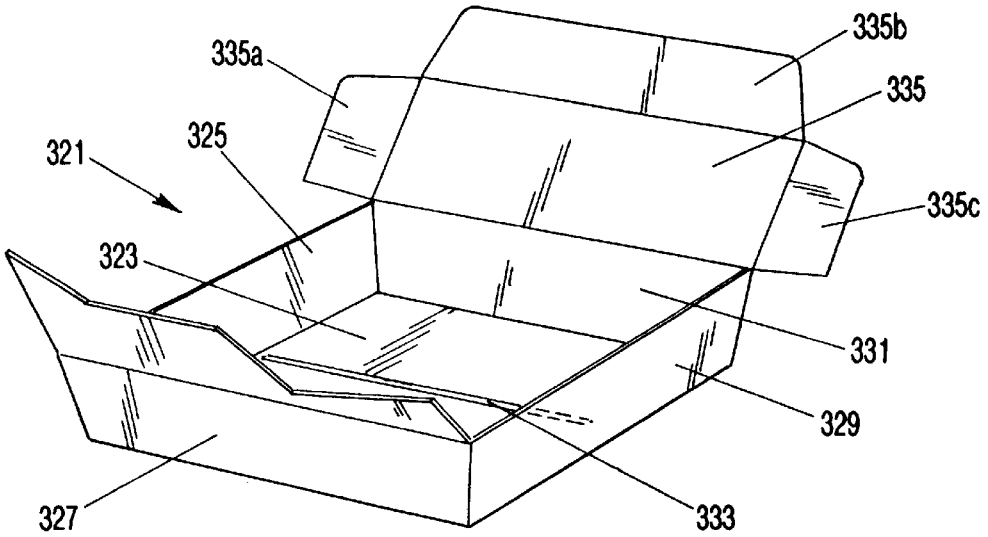
Figure 31:
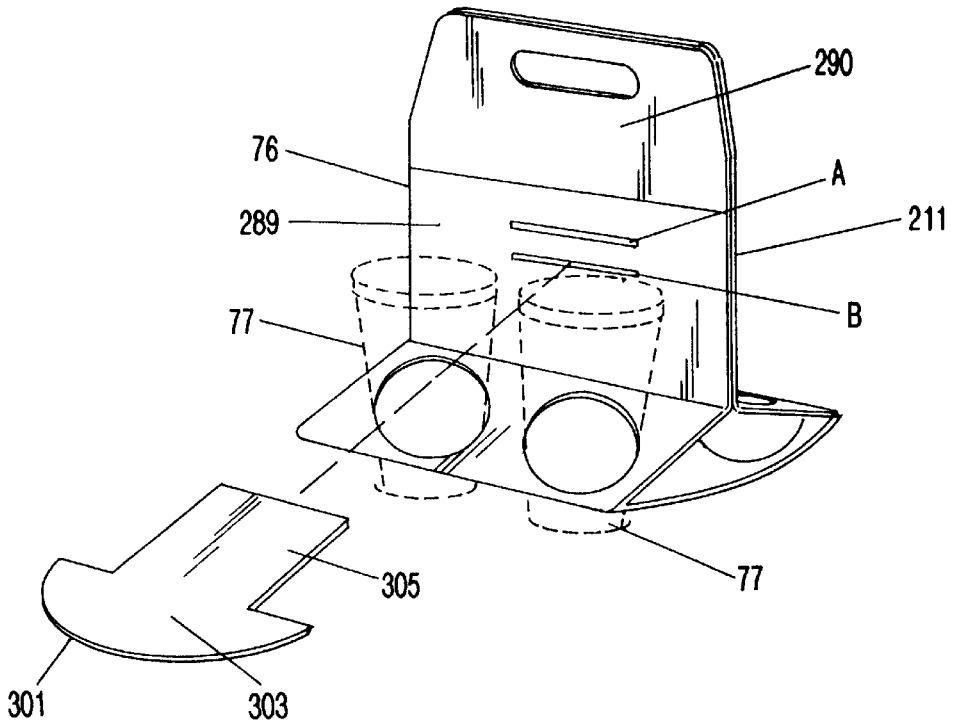

FIG. **28*a*** is an alternate locking means of the present invention;

FIG. 29 is a top view of another alternate locking means of the present invention;

FIG. 30 is a bottom view of the locking means illustrated in FIG. 29; and FIG. 31 illustrates an alternative carrier, an alternative food tray and a locking means of the present invention, all in a position illustrating the loading of drinking or food cups.

DESCRIPTION OF THE PREFERRED EMBODIMENT

Figure 1:
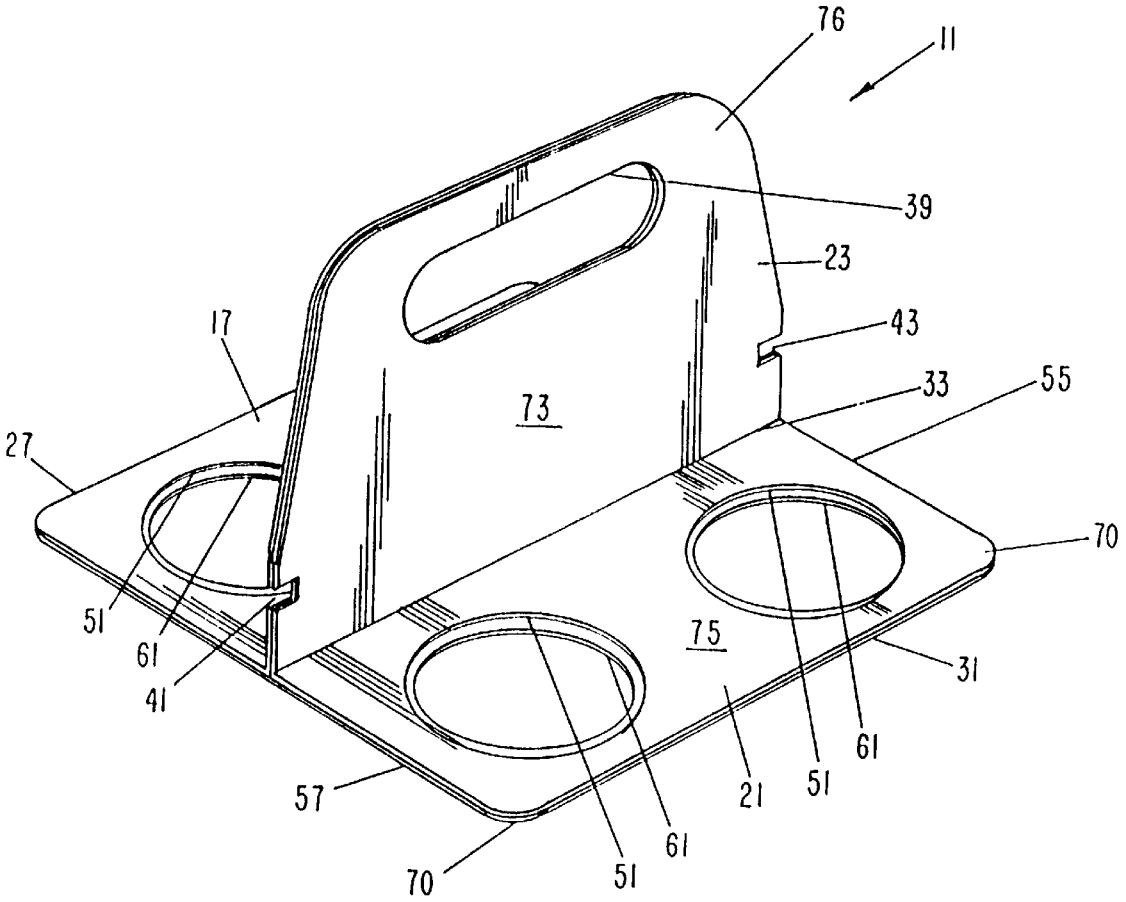
FIG. 1 is a side perspective view of the carrier constructed in accordance with principles of the present invention in a partially unfolded, loading position.

FIG. 1 illustrates carrier 11 constructed in accordance with principles of the present invention, in a partly unfolded position wherein it is ready for loading. Carrier 11 is made by folding a sheet of cardboard 13 or other foldable sheet material in the configuration illustrated in FIG. 2.

Figure 2:
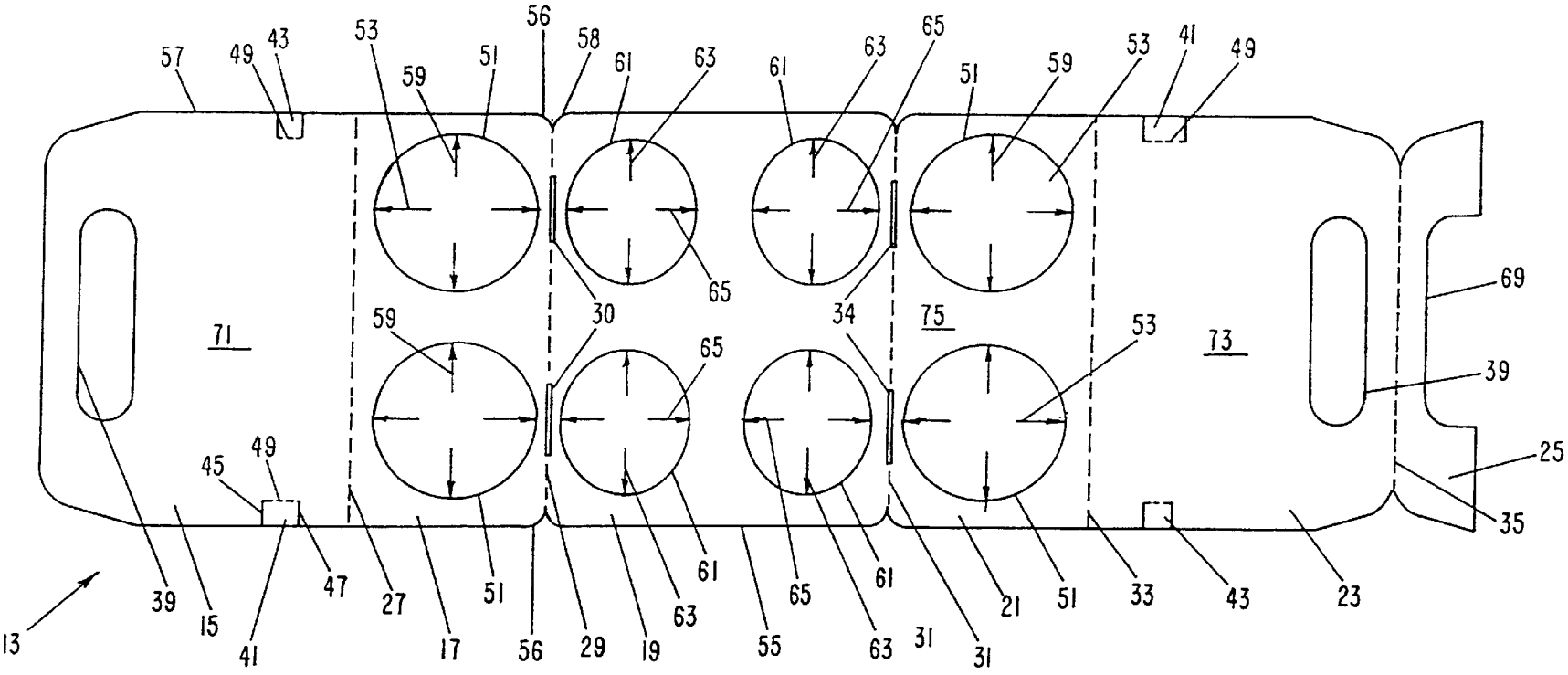
FIG. 2 illustrates a blank sheet from which the carrier of FIG. 1 is formed.

As seen in FIG. 2, sheet 13 is divided into six different sections or panels (i.e., 15, 17, 19, 21, 23 and 25) by five substantially parallel fold or hinge lines (i.e., 27, 29, 31, 33, and 35). The first, or handle section 15 includes handle cutout 39, large tab 41 and an opposed small tab 43. Each of tabs 41 and 43 is defined by a pair of parallel cuts in sheet 13 (as indicated by solid parallel lines 45, 47) and a fold line (as indicated by broken line 49). Section 17 includes a pair of spaced apart identical elliptical openings 51, each having its principle or major diameter 53 parallel to edges 55 and 57, and its minor diameter 59 perpendicular to edges 55 and 57. Section 19 includes four identical spaced apart and elliptical openings 61, each having its major diameter 63 perpendicular to edges 55, 57. The minor diameter 65 of each opening 61 is parallel to edges 55, 57. Section 21 is identical in size and configuration to section 17, having a pair of spaced apart elliptical openings 51, each opening having a major diameter 53 and a minor diameter 59. Panel 23 is identical in size to panel 15 and includes a second handle cutout 39 and tabs 41 and 43. However, the orientation of tabs 41 and 43 on panel 23 is reversed from that on panel 15, for the purpose set forth below. Section 25, which is a handle reinforcing flap, includes cut out 69. Finally, edges 55 and 57 include a plurality of cutouts (e.g., 56, 58, 80, 82) so that carrier 11 has rounded corners as indicated at, for instance, 70 and 84 in FIG. 1.

Preferably, sheet 13 is paper board stock, coated on the outboard side to be as water resistant as possible, and with a thickness of not less than 0.024 caliber in order to adequately support up to twelve pounds of potential load weight. The outboard sides 71 and 73 of, respectively, sections 15 and 23, form the primary advertising and promotional panels of carrier 11.

Carrier 11 is formed from sheet 13 by folding reinforcing flap 25 down and gluing it to the inboard face (not shown) of panel 23. With reference to FIG. 2, face 73 is folded along fold line 33 (defined by a series of small dash-like perforations) toward the outboard face 75 of section 21; the inboard face (not shown) of section 19 is folded along line 31 (defined by small dash-like perforations in series with two elongated slots 34) onto the inboard face (not shown) of section 21; the inboard face (not shown) of section 17 is folded along line 29 (adjacent to cutouts 56, 58 and defined by small dash-like perforations in series with two elongated slots 30) onto the inboard face of section 19; and the inboard face (also not shown) of section 15 is folded along line 27 (defined by a series of small dash-like perforations) to cover the inboard side of section 23 and flap 25, thereby resulting in a three layer reinforced handle portion. A gluing pattern (not shown) permanently bonds the facing inboard sides of panels 15 and 23 together (forming handle portion 76 as seen in FIG. 1), with carrier 11 having the fully folded configuration illustrated in FIG. 3. Thus, when carrier 11 has been manufactured, it is completely folded for ease in packing, transportation, and storage prior to use by a fast food vendor, and is provided with rounded edges on all exposed corners for safety to patrons.

Figure 3:
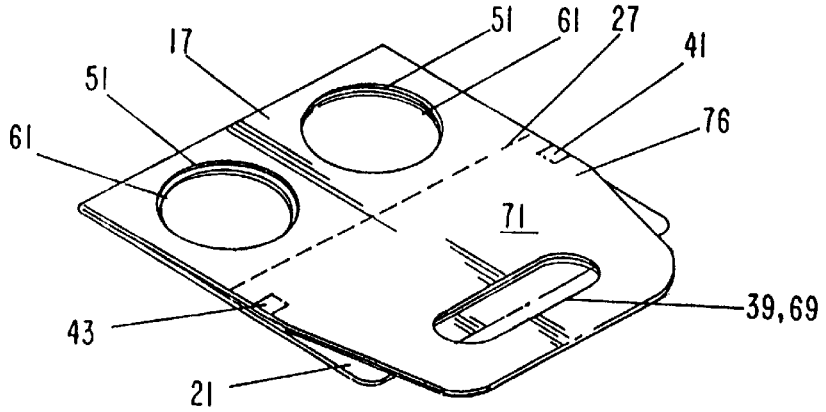
FIG. 3 illustrates the carrier of FIG. 1 in a completely folded position.
Figure 4:
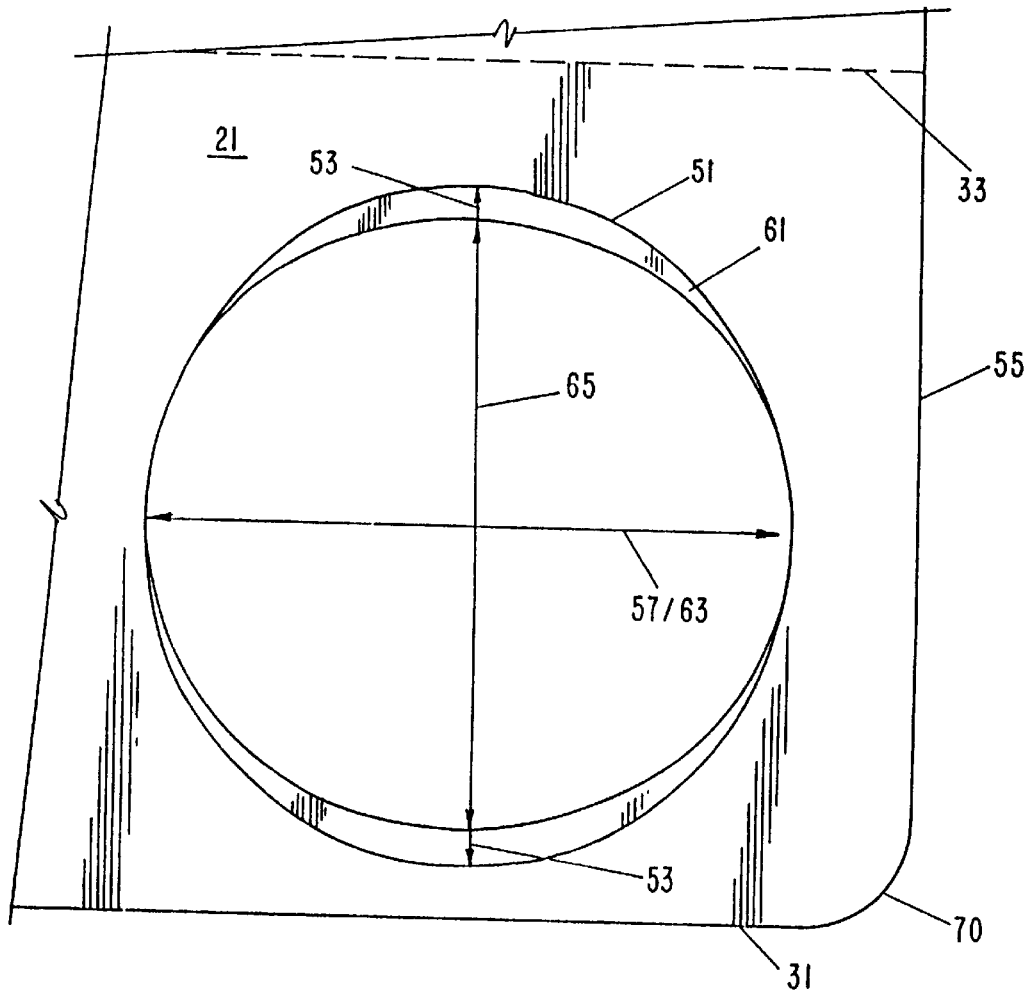
FIG. 4 is an enlarged plain view of one of the pairs of aligned cut-outs used to hold a beverage container or drinking cup.

With the arrangement illustrated in FIGS. 1 and 3, elliptical openings 51 in sections 17 and 21 are aligned with elliptical openings 61 in section 19. This alignment is best illustrated in FIG. 4, wherein major diameter 53 of opening 51 is perpendicular to major diameter 63 of opening 61. As is also best illustrated in FIG. 4, elliptical opening 61 is smaller than elliptical opening 51, with major diameter 63 approximately equal to minor diameter 59. For illustrative purposes: diameters 59, 63 are 3 3/32"; diameter 53, 3 9/32; and diameter 65, 2 29/32. In order for openings 51, 61 to both hold a drinking cup, such as illustrated at 77 in FIG. 6 (with lid 78), it is critical that they be elliptical in shape, with crossing major diameters (as illustrated in FIG. 4). If round apertures are used, the bottom aperture does not hold drinking cup 77 with equal pressure, thereby reducing the reliability of carrier 11, especially if carrier 11 is moist or damp. In contrast, the elliptical apertures hold cup 77 with almost equal pressure, thereby holding cup 77 more firmly and upright.

In operation, only a partial unfolding by the fast food operator of completely folded carrier 11 is needed in order to load carrier 11 with drinking cups 77. This partial unfolding is accomplished by grasping handle portion 76 and moving handle portion 76 (constituting glued together panels 15, 23 and 25) through a 90° arc from the position illustrated in FIG. 3, to the position illustrated in FIGS. 1 and 6. For this purpose, perforated fold lines 29, 33 constitute a hinge. In this position, inward facing surfaces of sections 17, 19 and 21 are still in substantial face-to-face contact with each other. Elliptical openings 51 and 61 are in near registry with each other, as illustrated in FIG. 4, and lie close to the working surface (e.g. a fast food service counter). Preferably, the distance between perforated fold lines 27, 33 and handle cut outs 39, 69 is greater than the height of drinking cup 77, thereby allowing additional space for promotional material on handle portion 76 and also minimizing operator contact with the surface of a drinking cup 77 when carrier 11 is grasped. A single drinking cup 77 can be placed in at least one registered opening 51, 61. The operator can then release the handle portion 76, and continue to load additional drinking cups 77 without need for continually retaining handle portion 76. Drinking cups 77 are merely placed on the working surface within the respective registered openings 51, 61. The movement of carrier 11 to its operative position is completed merely by grasping handle portion 76 and lifting. As handle portion 76 is raised in a substantially vertical direction, the sections 17 and 21 move upwardly and carry with them section 19 by means of the hinged connection previously formed by folding on lines 29 and 31. Since openings 61 in section 19 are smaller than openings 51 in sections 17 and 21, the vertically moving carrier 11, being lifted by handle portion 76, will cause smaller openings 61 to engage a lower portion of the conical tapered external surfaces of cups 77 while openings 51 engage a higher portion thereof. This initial engagement with openings 61 occurs while cups 77 are still resting atop the working surface that supports both cups 77 and carrier 11 during loading. Further upward movement of handle portion 76 begins to transfer the weight of cups 75 from the working surface to section 19 which, accordingly, tends to bow downwardly below a substantially horizontal plane that contains fold lines 29 and 31. This plane is represented as containing a line 79, as illustrated in FIG. 7. Further upward motion of handle portion 76 moves the sections 17 and 21 upwardly relative to the horizontal plane containing fold lines 29 and 31, and relative to drinking cups 77, until openings 51 also engage the sides of drinking cups 77 as illustrated in FIG. 7.

If deemed necessary or advisable for each pair of registered openings, lower opening 61 may be offset inwardly (i.e., toward handle portion 76) relative to upper opening 51 by a small amount since the inner edge of lower opening 61 will tend to move outwardly relative to upper opening 51 as upper support panels 17 and 21 are vertically displaced relative to lower support panel 19 during the final step of the movement of carrier 11 to its operative position. Thus, in the fully operative position illustrated in FIG. 7, upper and lower openings 51, 61 will be more nearly vertically aligned.

Figure 11:
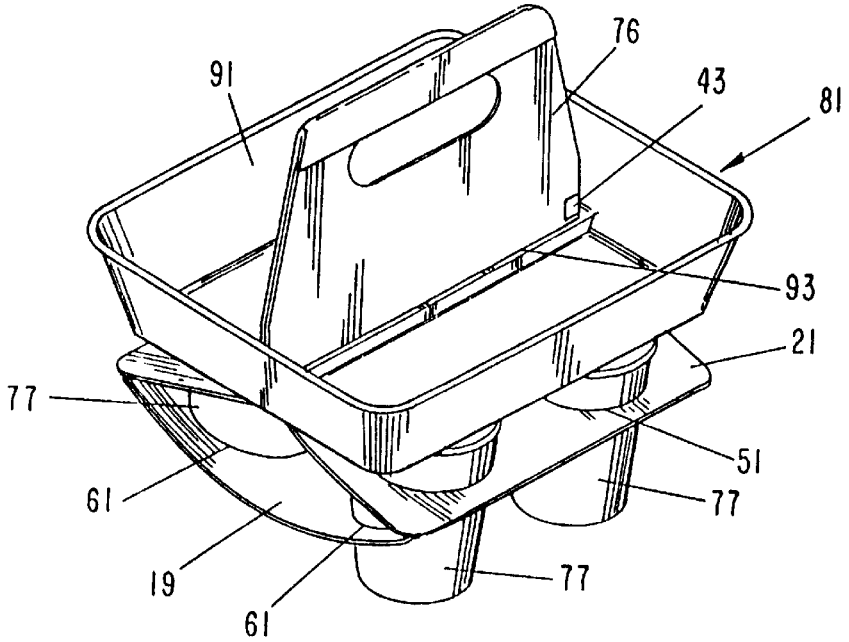
FIG. 11 illustrates the carrier in fully operative position including the plurality of drinking cups supporting the tray of FIG. 8.

Thus, complete unfolding, as illustrated in FIGS. 7 and 11, is not actually a separate step since it occurs during and by virtue of the very act of lifting carrier 11 in its normal manner for the purpose of removing carrier 11 and drinking cups 77 from the working surface (e.g. fast food service counter) for transferring and transporting to the desired location.

Figure 8:
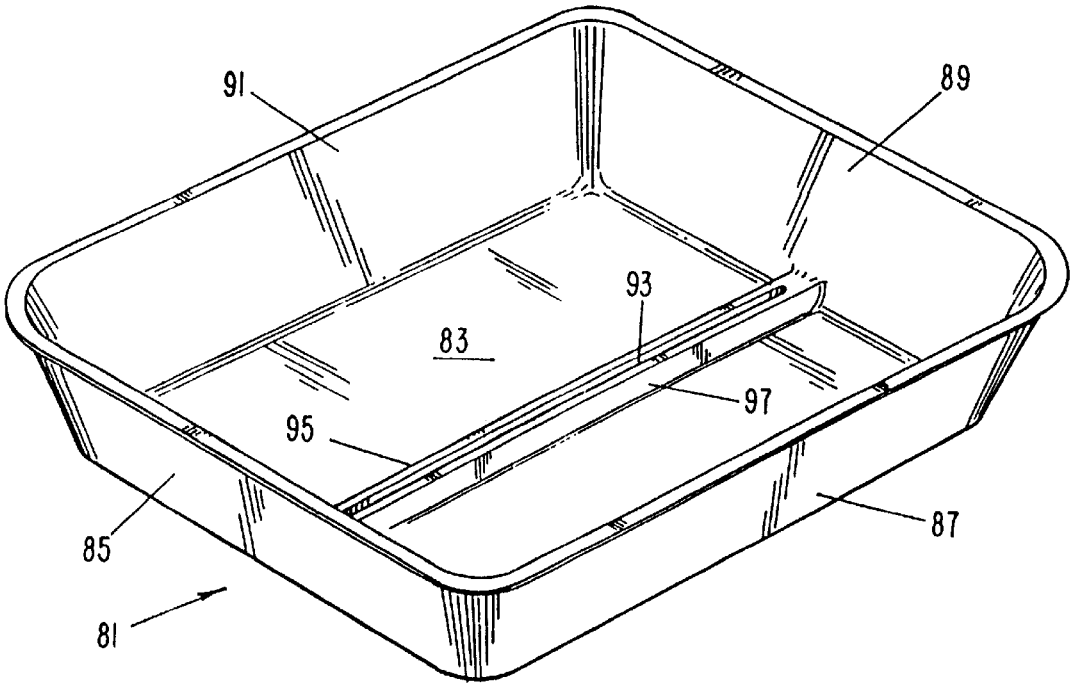
FIG. 8 is a side perspective view of a tray adapted to be employed with the carrier of FIGS. 1–7.

Illustrated in FIG. 8 is an auxiliary container 81 adapted to be used in conjunction with carrier 11, and to be supported upon drinking cups 77 carried in carrier 11. Auxiliary container 81, which is formed or molded, includes a bottom member 83, having upstanding walls 85, 87, 89 and 91 fixed thereto. Formed in bottom member 83 is a slot 93, defined between first and second parallel spaced ribs 95 and 97 that are either fixed to or formed integrally with bottom member 83. Ribs 95, 97, which extend substantially from wall 85 to wall 89, provide a number of functions. First, they reinforce the bottom of container 81, and in particular, the sides of slot 93. In addition, they may extend sufficiently above the container bottom to divide the container into separate compartments to facilitate loading of different food items. Still another function accomplished by ribs 95 and 97 is to aid in positioning auxiliary container 81 relative to handle portion 76 (formed by panels 15, 23 and 25), which will extend through slot 93 as more particularly described below. Further, auxiliary container 81 may be provided with a closable cover or cover panels (not illustrated) as may be considered appropriate or useful for particular applications. In some instances, auxiliary container 81 can also function as a cover member. In such operation, the cover member is inserted in an inverted position onto handle portion 76, to thereby cover the food items located in auxiliary container 81. The cover member is especially valuable when the adverse surrounding environment necessitates enclosing the auxiliary container and thereby protecting the food items inside.

Figure 9:
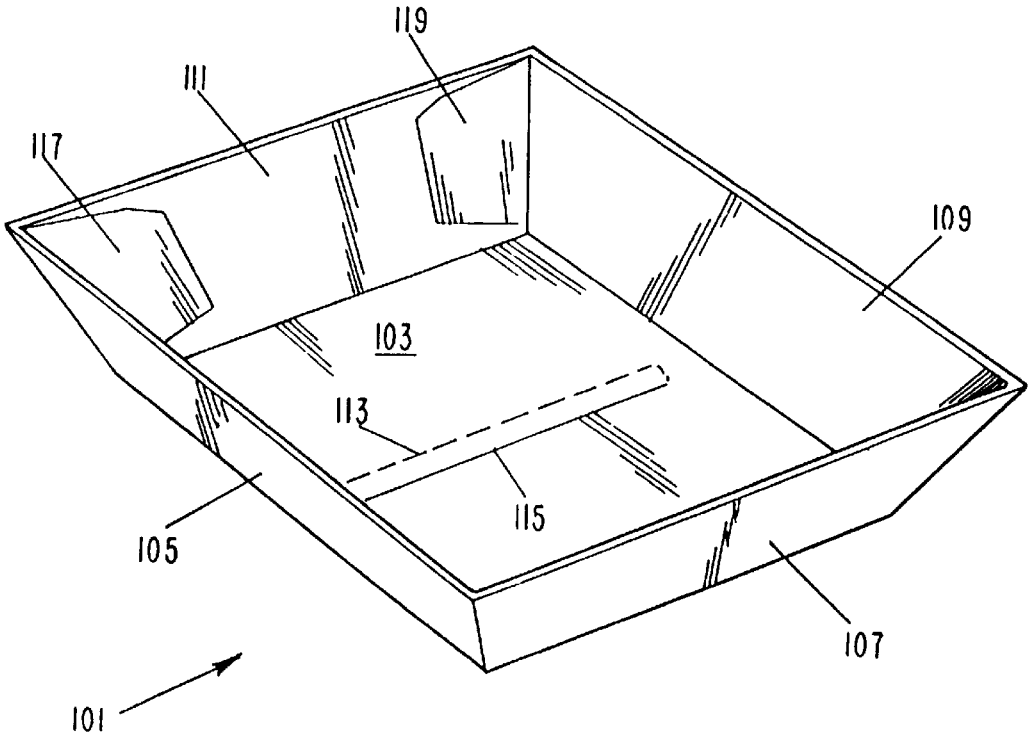
FIG. 9 is a side perspective view of an alternate tray of the present invention.

FIG. 9 illustrates alternate tray 101, including a bottom portion 103, and side portions 105, 107, 109 and 111. Portion 103 includes a scored or perforated slot 113 and a fold line 115. Slot 113 is scored rather than cut so it will remain in place as a full foundation of a separately usable tray 101, or propped up to slide over handle portion 76 of carrier 11, in substantially the same manner as tray 81.

Figure 6:
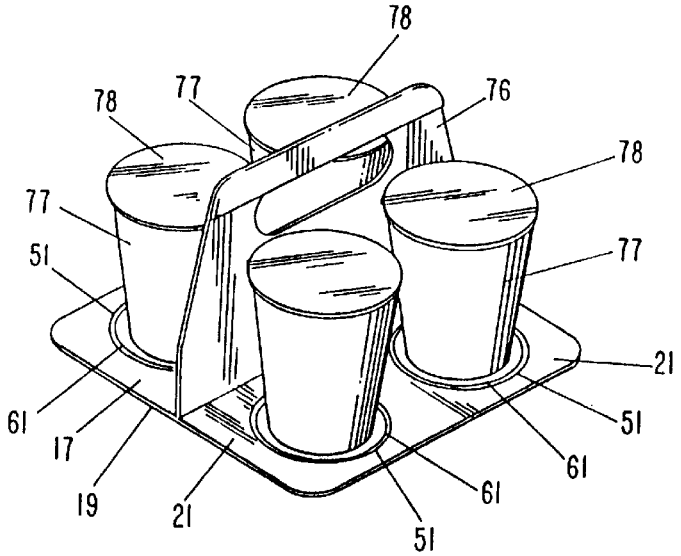
FIG. 6 shows the carrier in its loading position, with a plurality of drinking cups positioned for support by the carrier.
Figure 7:
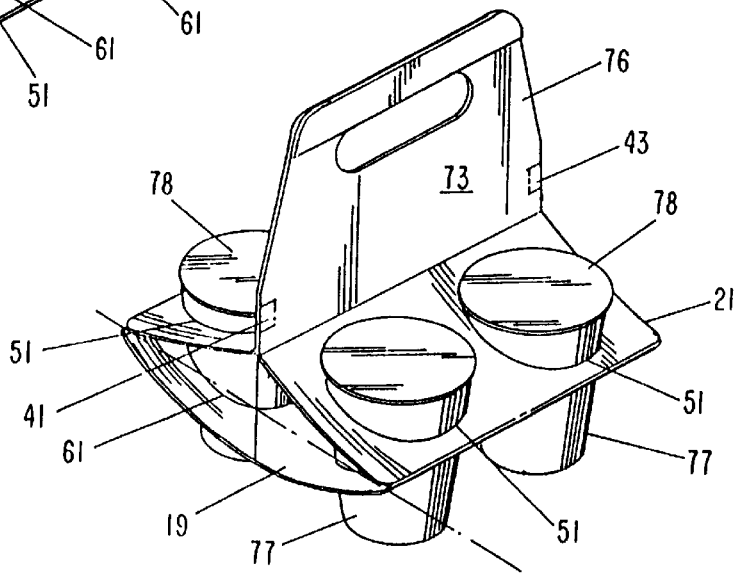
FIG. 7 shows the carrier in completely operative position with a plurality of drinking cups supported thereby.
Figure 10:
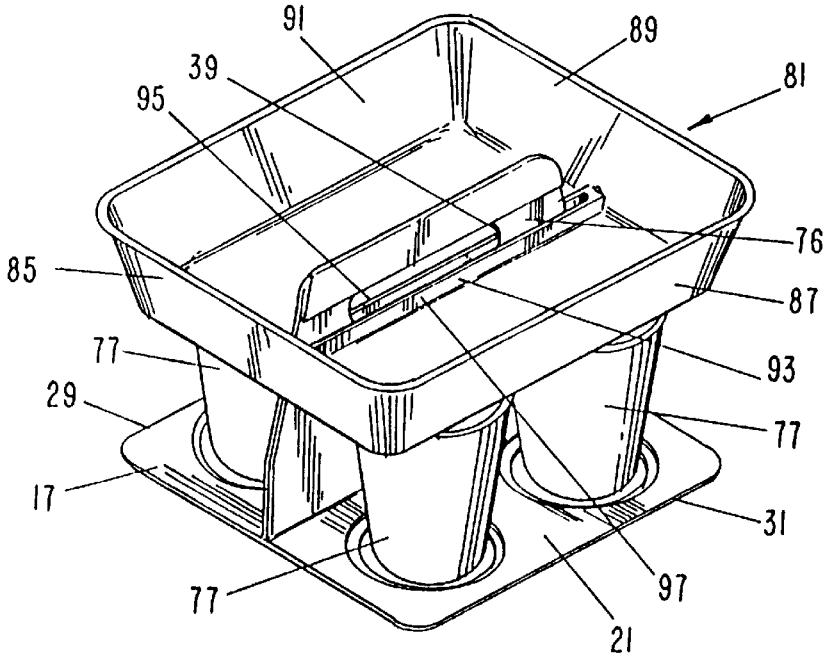
FIG. 10 illustrates the carrier in its loading position with the tray of FIG. 8 loaded atop the drinking cups.

Tray 81 may be formed of paperboard or other stiff sheet material of the same type as the material from which carrier 11 is formed. Alternatively, a thin a sheet of plastic such as sheet Styrofoam may be integrally molded to the configuration illustrated in FIG. 8. Tray 101 is formed from paperboard, with side portions 105 and 109 having integral tabs (such as illustrated at 117, 119), which tabs are glued to sides 107, 111.

Where tray 81 or 101 is to be employed, carrier 11 is first partly unfolded to the position illustrated in FIG. 6. Drinking cups 77, which are the primary containers to be supported by carrier 11, are placed in openings 51, 61 as previously described. Then, in the first embodiment, tray 81 is placed atop cups 77, with handle portion 76 extending through the slot 93 of bottom 83. Tray 81 may then be filled with various additional items (e.g. such as food and eating utensils) or it may be so filled with items before positioned on carrier 11, as shown in FIG. 10. As those skilled in the art will appreciate, the length of handle portion 76 from fold lines 27, 33 to the lower portion of handle cutout 39, is sufficient to insure that cutout 39 extends sufficiently above bottom 83 of tray 81 to allow handle portion 76 to be easily grasped even when tray 81 is positioned on carrier 11.

In operation, as handle portion 76 is grasped and moved vertically upward from the position illustrated in FIG. 10, the same action occurs as described in connection with the movement from the position of FIG. 6 to the position of FIG. 7, except that because of the additional weight of the drinking cups (due to the weight of tray 81 and its contents), both section 19 and sections 17 and 21 will deflect somewhat further than without tray 81, before carrier 11 and its contents are lifted clear of the working surface. Thus, in fully unfolded and operative position, carrier 11, bearing drinking cups 77 and tray 81, assumes the position illustrated in FIG. 11. Tray 101 operates in substantially the same manner as tray 81.

Figure 5:
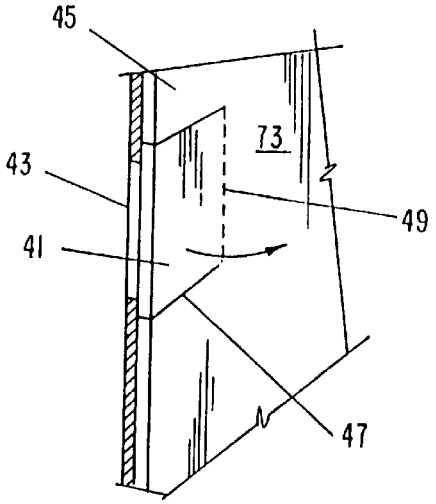
FIG. 5 is an enlarged side perspective view of one of the pair of push-tabs which may be used to help hold the tray of either FIG. 8 or FIG. 9 in place and to keep "lift" on the handle as hereinafter disclosed.

Once tray 81 or 101 is in the position illustrated in FIG. 11, tab pairs 41, 43 may be pushed out as illustrated in FIG. 5. Because tab portion 43 is smaller than tab portion 41, each of the two tab pairs may only be pushed in one direction. This results in counter pressure points, one on each side of slot 93. The outward movement of the tab pairs 41, 43 locks tray 81 (or 101, as the case may be) in position, with the underside of surface 83 (not shown) being in engagement with cup lids 78. Thus, with the tab pairs 41, 43 in use, "lift" is kept on handle portion 76 of container 11 when the consumer sets carrier 11 down and releases handle portion 76. This maintains the support on cups 77 provided by openings 51, 61.

Alternate carrier 11' and tray 121 are illustrated in FIGS. 12–16. Except for locking notches 123 provided in edges 55' and 57' handle portion 76', carrier 11' is identical in construction and function to carrier 11. Accordingly, like parts are designated with a prime character (').

Figure 12:
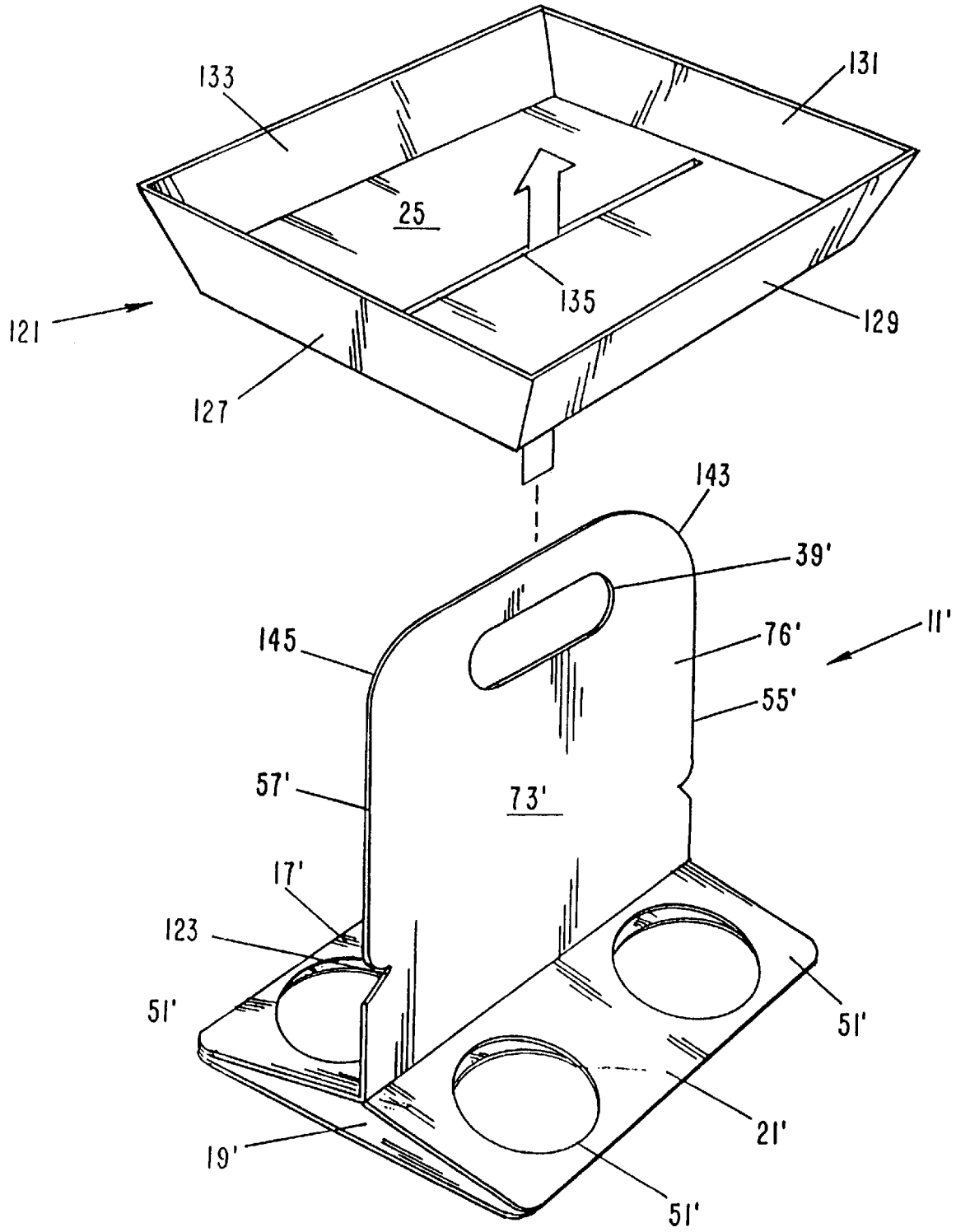
FIG. 12 is a perspective view of an alternate carrier and tray.
Figure 13:
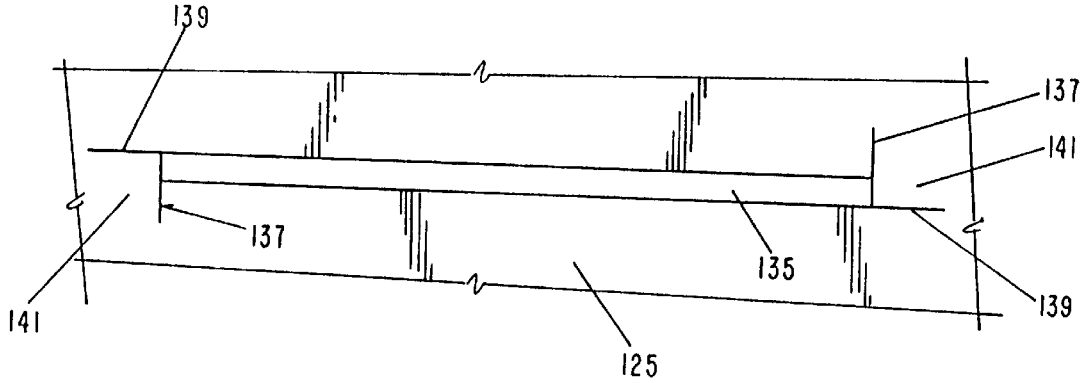
FIG. 13 is a partial top plain view of the tray of FIG. 12.
Figure 14:
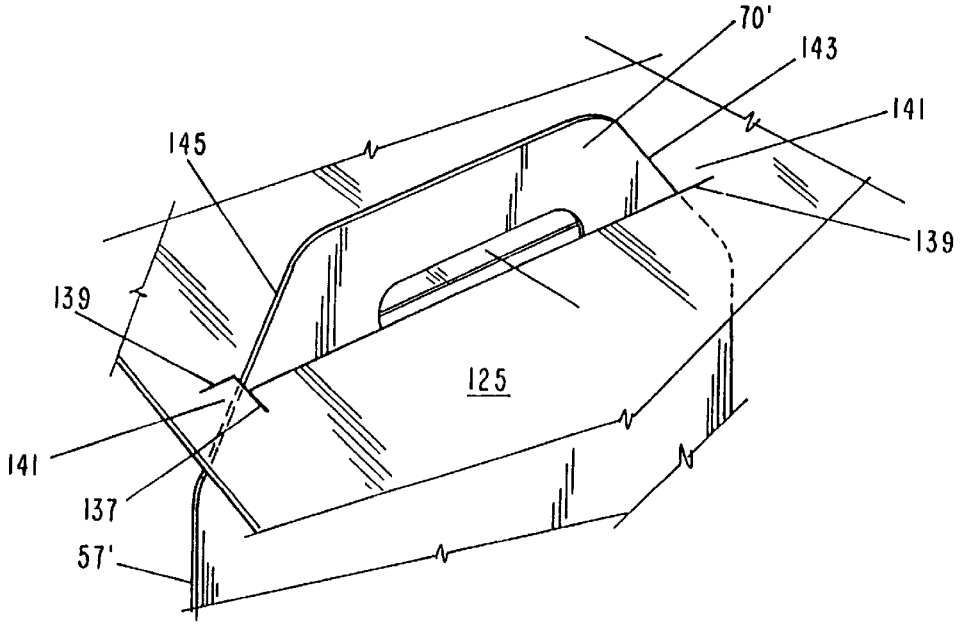
FIGS. 14–16 are partial side perspective views showing the assembly of the tray and carrier of FIG. 12.
Figure 15:
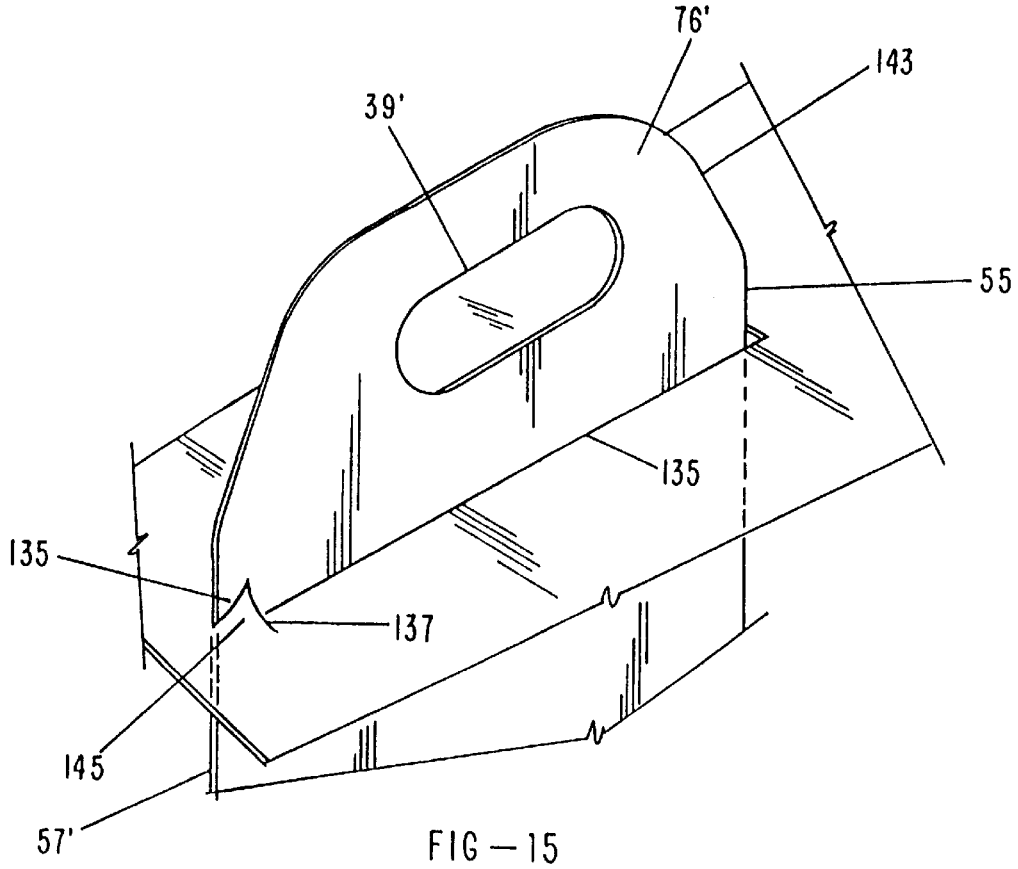
Figure 16:
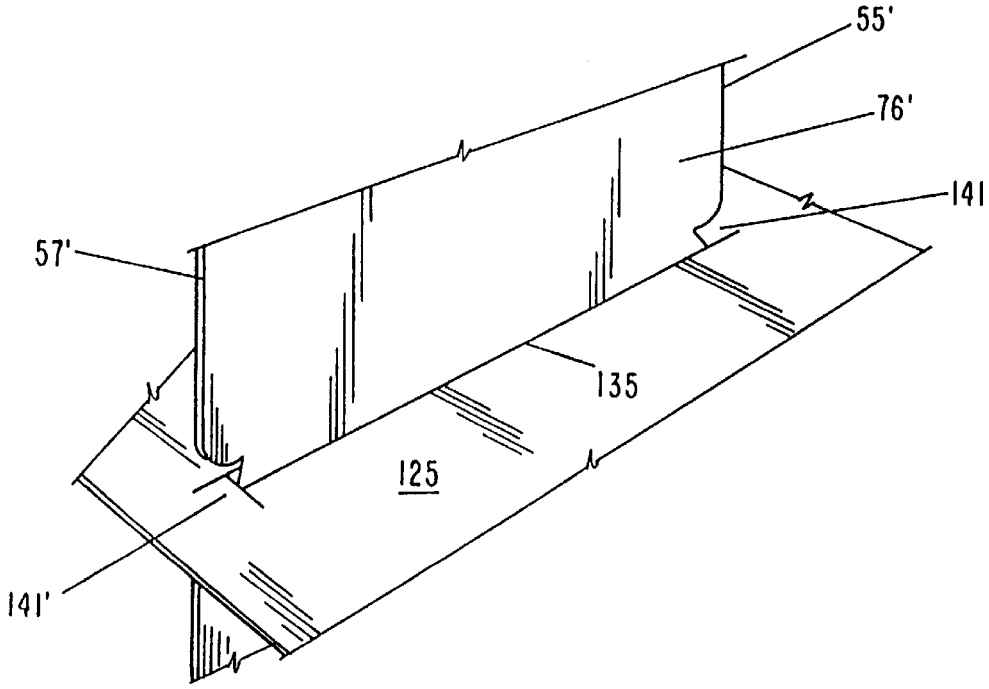
Figure 17:
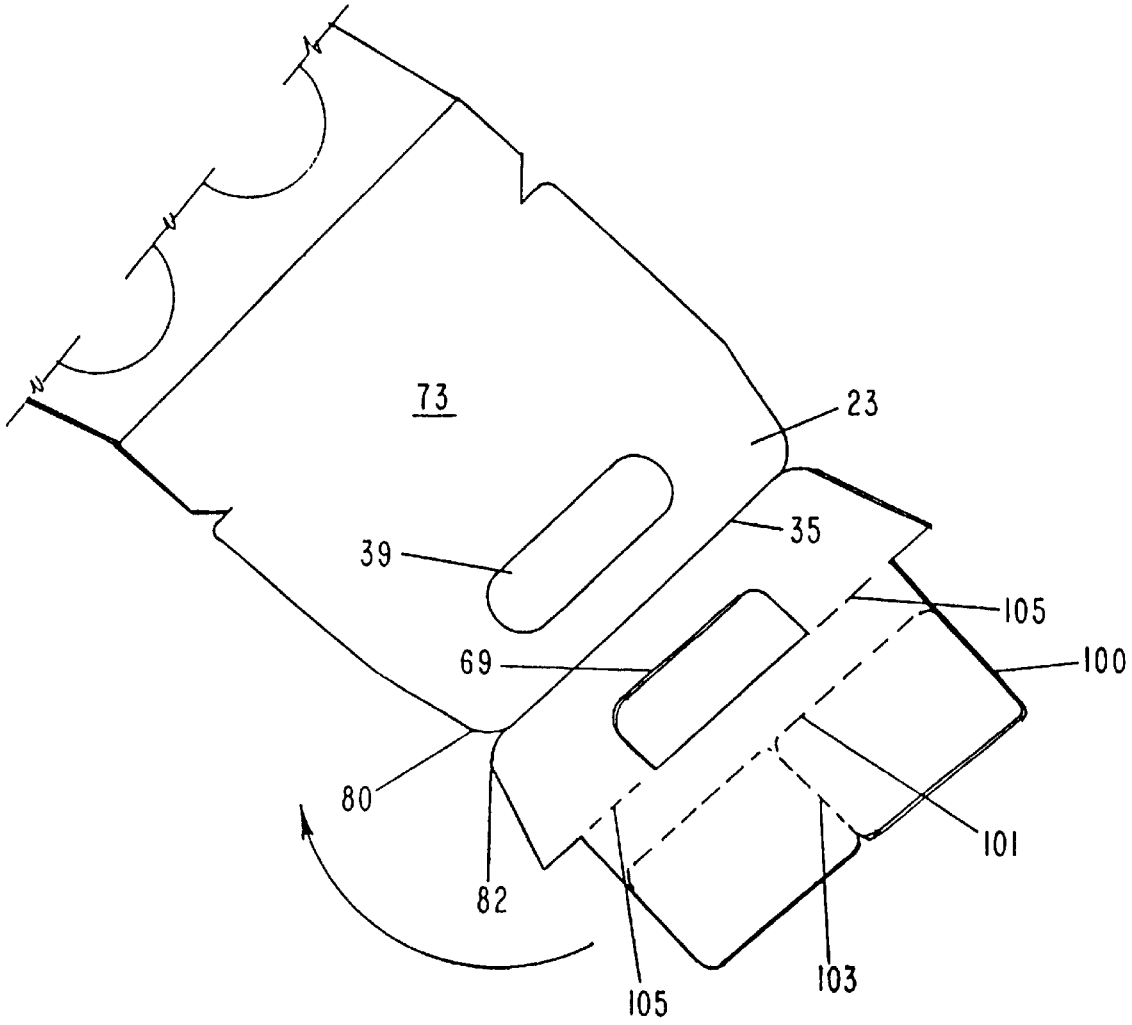
FIGS. 17–18 are partial side perspective views of an alternate carrier of the present invention.
Figure 18:
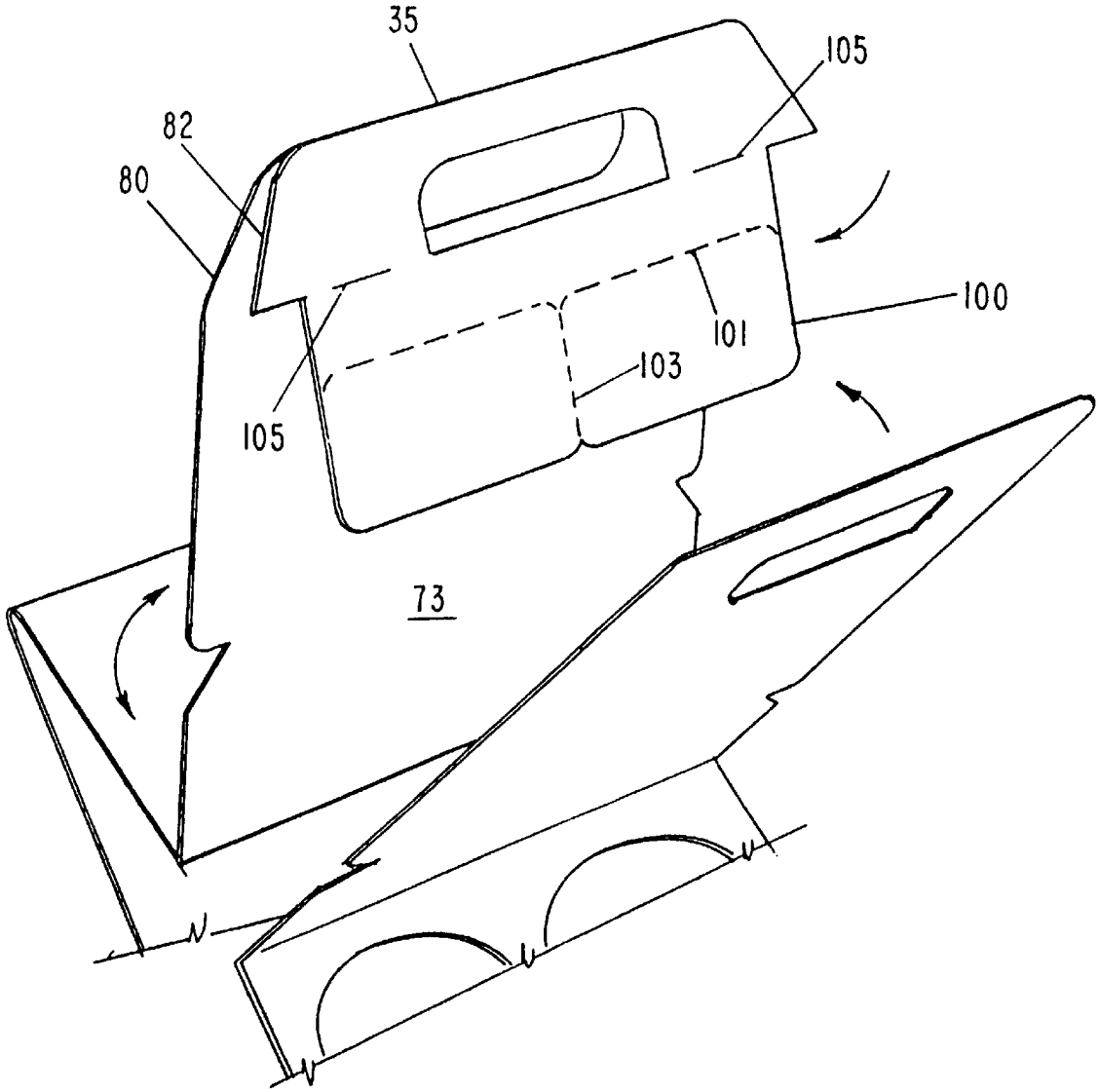

Tray 121 includes a bottom 125, four sides 127, 129, 131 and 133, and an elongated die cut slot 135. As best seen in FIG. 13, on the opposite corners of slot 135 are perpendicular die cuts 137 and 139, which form tabs 141 and 141*b*. In operation, as illustrated in FIGS. 14–16, as tray 121 is pushed down over handle portion 76', edges 143, 145 forces tabs 141*a* and 141*b* in an upward direction. During continued downward motion, as seen in FIG. 15, edges 55' and 57' maintain tabs in an outward position until the underside of surface 125 (not shown) engages lids 78 and tabs 141*a* and 141*b* move into notches 123 under spring action. As shown in FIGS. 12 and 16. Thus tabs 141*a* and 141*b* achieve the same end result as tab pairs 41, 43.

Figure 19:
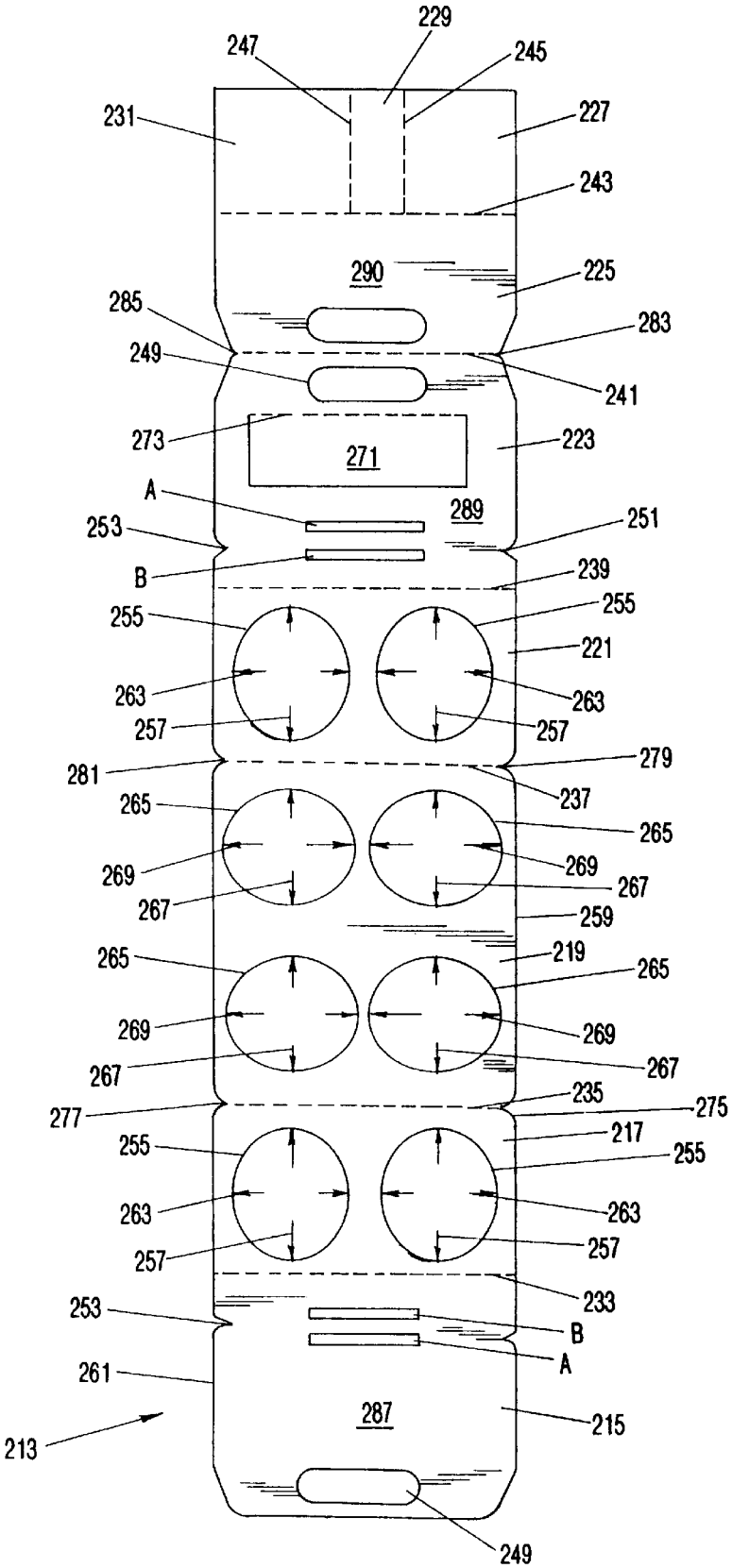
FIG. 19 illustrates a blank sheet from which an alternate carrier of FIG. 31 is formed.

FIG. 19 represents another alternative embodiment of the present invention. As seen in FIG. 19, carrier (or transport) 211 is made by folding a sheet of cardboard 213 or like, foldable, rigid sheet of material. Sheet 213 is divided into nine primary sections of panels (i.e., 215, 217, 219, 221, 223, 225, 227, 229 and 231) by eight fold or hinge lines (i.e., 233, 235, 237, 239, 241, 243, 245 and 247). The first, or handle section 215 includes handle cutout 249, large notch 251 and an opposed small notch 253. Panel 215 further includes slots A and B formed therein at a point substantially between notches 251 and 253, the purpose of which is discussed below. Section 217 includes a pair of spaced apart identical elliptical openings 255, each having its principle or major diameter 257 parallel to edges 259 and 261, and its minor diameter 263 perpendicular to edges 259 and 261. Intermediary section 219 includes four identical spaced apart and elliptical openings 265, each having its major diameter 267 perpendicular to edges 259, 261. The minor diameter 269 of each opening 265 is parallel to edges 259,261. Section 221 is identical in size and configuration to section 217, having a pair of spaced apart elliptical openings 255, each opening having a major diameter 257 and a minor diameter 263. Panel 223 is substantially similar to panel 215 and includes a second handle cutout 249, notches 251 and 253 and slots A and B. Section 223 further includes optional panel 271 which is attached to panel 223 through perforated hinge line 273. Section 225, which is a handle reinforcing flap, is substantially similar to panel 215, and includes cut out 249. Sections 227, 229 and 231 are attached to section 225 by a single perforated hinge line 243. Finally, edges 259 and 261 include a plurality of smooth finish cutouts (e.g., 275, 277, 279, 281, 283 and 285) so that carrier 211 has rounded corners as indicated in FIG. 31.

Preferably, sheet 213 is paper board stock, coated on the outboard side to be as water resistant as possible, and with an adequate thickness in order to adequately support a load typically found in the fast found marketplace. The outboard sides 271, 289, 290, as well as the outboard portion of option panel 271, form the primary advertising and promotional panels of carrier 211 and may (such as panel 271) be removable.

Carrier 211 is formed from sheet 213 by folding reinforcing flap 225 down across line 241 and attaching by conventional means to the inboard face (not shown) of panel 223. With reference to FIG. 19, face 289 is folded along fold line 239 (defined by a series of small dash-like perforations) toward the outboard face of section 221; the inboard face (not shown) of section 219 is folded along line 237 (defined by small dash-like perforations) onto the inboard face (not shown) of section 221; the inboard face (not shown) of section 217 is folded along line 235 (adjacent to cutouts 275, 277 and defined by small dash-like perforations) onto the inboard face of section 219; and the inboard face (also not shown) of section 215 is folded along line 233 (defined by a series of small dash-like perforations) to cover the inboard side of section 223 and flap 225, thereby resulting in a three layer reinforced handle portion. A gluing pattern (not shown) permanently bonds the facing inboard sides of panels 215 and 223 together (forming handle portion 76 as seen in FIG. 31), with carrier 211 having the fully folded configuration illustrated in FIG. 31. In this configuration, optional panel 271 is sandwiched between panel 215 and panel 223, yet due to perforation line 273, is easily removable by a patron. Thus, when carrier 211 has been manufactured, it is completely folded for ease in packing, transportation, and storage prior to use by a fast food vendor, and is provided with rounded edges on all exposed corners for safety to patrons.

Figure 20:
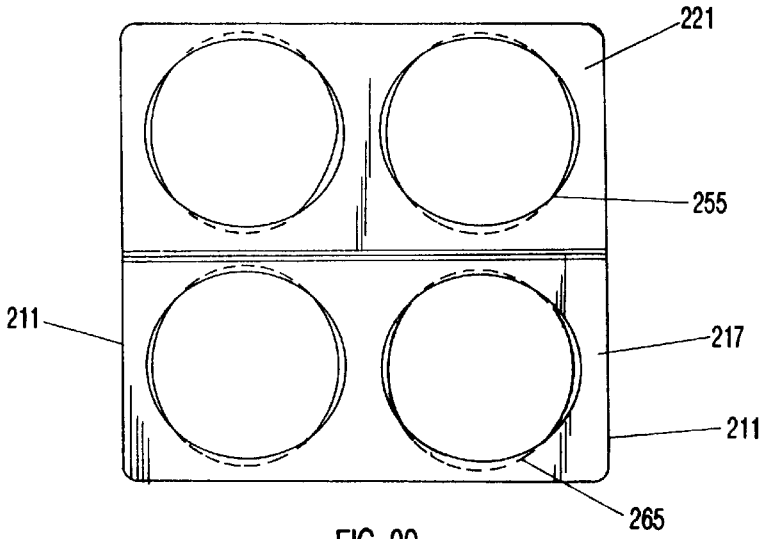
FIG. 20 is a top view of the alternate carrier of FIG. 31.

With the arrangement as illustrated in FIGS. 19 and 31, elliptical openings 255 in sections 217 and 221 are aligned with elliptical openings 265 in section 219. In this configuration, major diameter 257 of opening 255 is perpendicular to major diameter 269 of opening 265. Preferably, elliptical opening 265 is smaller than elliptical opening 255 (as shown in FIG. 20), with major diameter 269 approximately equal to minor diameter 263. For example, the following dimensions could be used: diameters 263, 269 are 3 3/32"; diameter 257, 3 9/32; and diameter 267, 2 29/32. In order for openings 255, 265 to both receive and retain a drinking cup, such as illustrated in FIG. 31, it is critical that they be elliptical in shape, with crossing major diameters (as discussed above and illustrated in FIG. 4). If round apertures are used, the bottom aperture does not hold drinking cup 77 with equal pressure, thereby reducing the reliability of carrier 211, especially if carrier 211 is moist or damp. In contrast, the elliptical apertures as described herein hold cup 77 with almost equal pressure, thereby holding cup 77 more firmly and upright. Moreover, it is within the scope of this invention that elliptical pair openings 255/265 be substantially proportionate so that various cup containers may fit into any of the elliptical pair openings. Thus, the present invention can be adapted not only to carry drink cups, but also other various sized containers such as popcorn containers (which usually differ in diameter from the drink cups).

Figure 21:
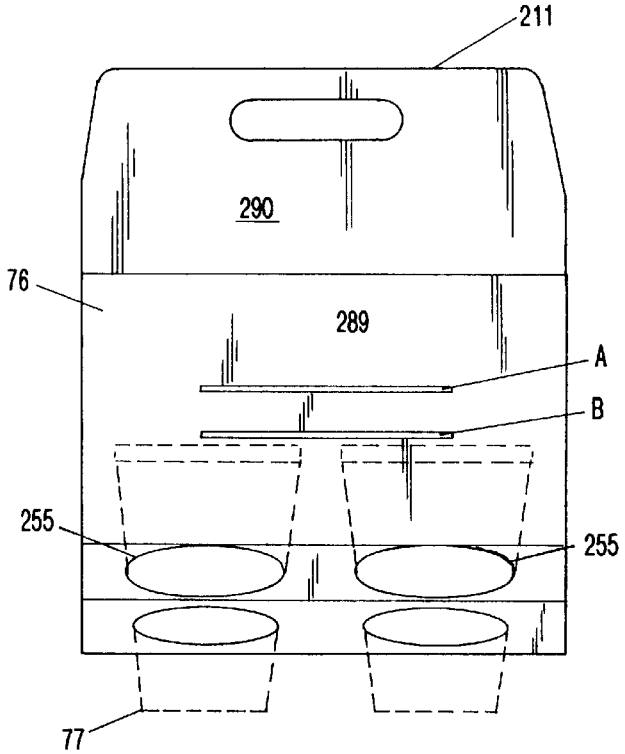
FIG. 21 is a side view of the alternate carrier of FIG. 31.
Figure 22:
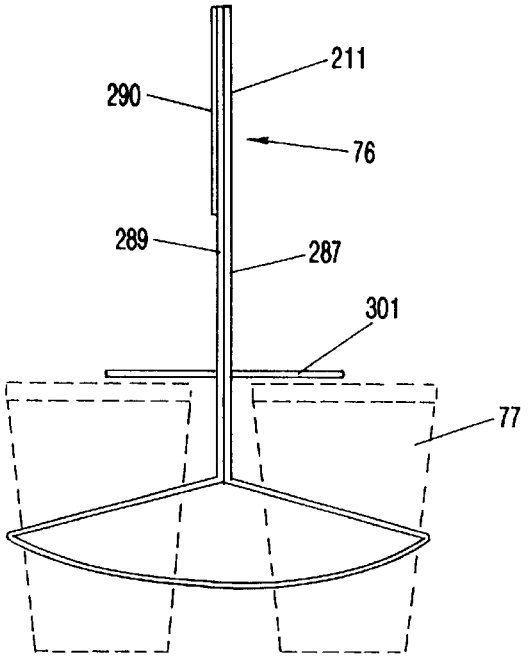
FIG. 22 is a left side view of the alternate carrier of FIG. 31.

Using carrier 211 is substantially similar to using carrier 11 as described above, and thus, only a partial unfolding by the fast food operator of completely folded carrier 211 is needed in order to load carrier 211 with drinking cups 77. However, in this configuration, slots A and B on panels 215 and 223 are now in approximately equal registry with each other. Preferably, slots A and B are formed at a point on handle portion 76 to approximate a portion of the height of standard drinking cups 77 so that when cups 77 are placed into at least one registered opening 255, 265, the operator can then insert head 305 of locking means 301 into either slot A or B (depending on the size of the cup) as generally demonstrated in FIGS. 21–22, release the handle portion 76 and allow locking means 301 to be supported by the cup. In this fashion, the operator can then continue to load additional drinking cups 77 without the need for continually retaining handle portion 76 in an upright position.

Figure 28:
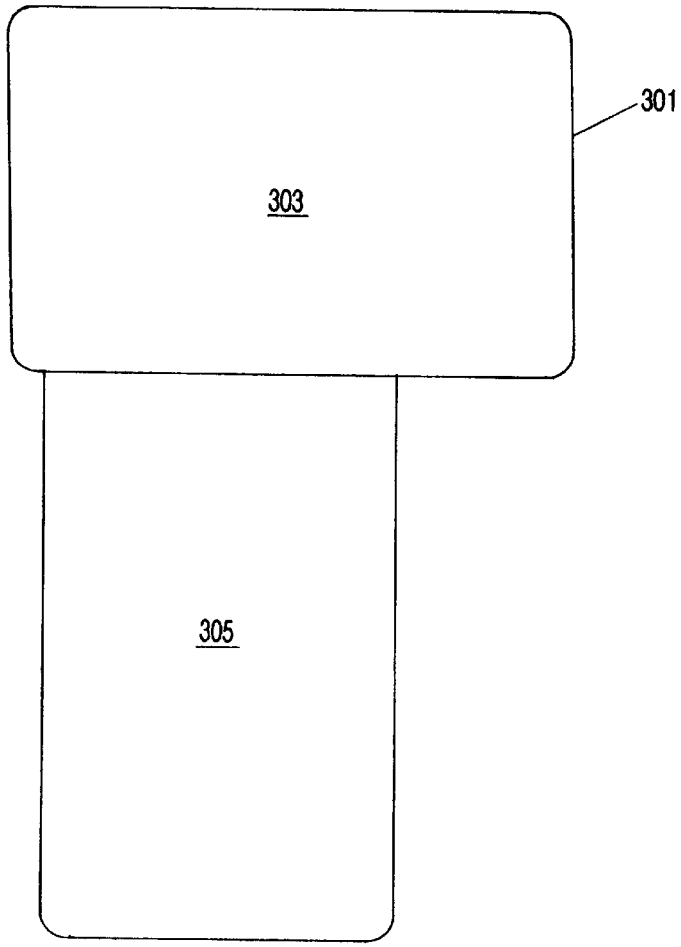
FIG. 28 is a top view of a locking means of the present invention.
Figure 28A:
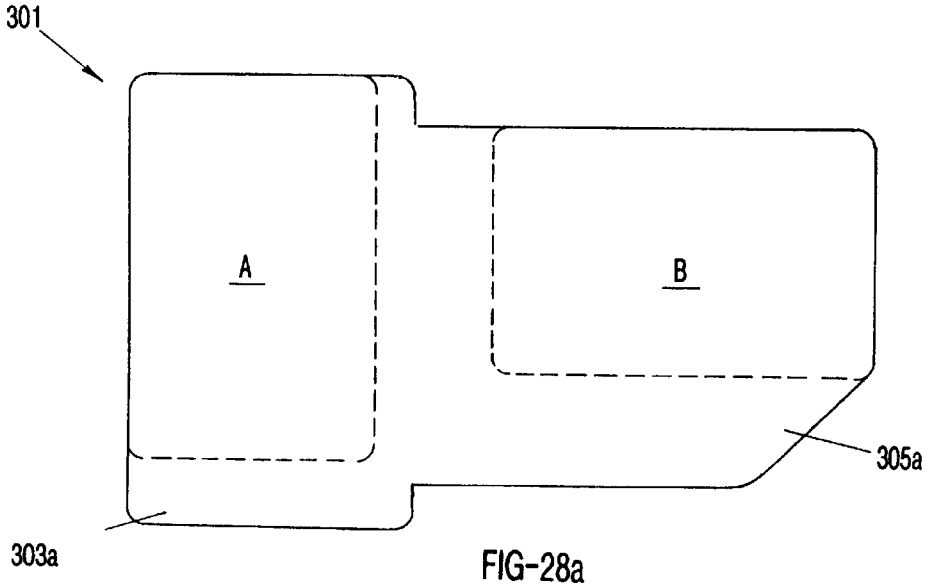

Preferably, as illustrated in FIGS. 28–30, locking means 301 is a rigid, flat key formed to insert into slot A or B at a point on handle portion 76 to approximate a fraction (such as, for example, half) of the height of a predefined container or cup. One embodiment of locking means 301 is illustrated in FIG. 28, having a rectangular head 303 and a rectangular body 305. Another embodiment of locking means 301 is illustrated in FIG. 28*a*, having a rectangular head 303*a* and a rectangular body 305*a*. In this embodiment, rectangular head 303*a* has a perforated portion A while rectangular body 305*a* has a perforated portion B. Still another embodiment of locking means 301 is illustrated in FIG. 29, having a semicircular head 303 and elongated body 305. Naturally, those of skill in the art will come to realize that other configurations of locking means 301 are available which are still within the scope of this invention. When locking means 301 engages or interlocks with handle portion 76 through body 305, the top of some of the cups 77 will apply upward pressure on the bottom face of locking means 301, and in turn, locking means 301 will provide an adequate force upon handle portion 76 to keep it in an upright position when the cups are on an uneven workplace surface. When carrier 211 is lifted, the top of cups 77 will move away from the bottom surface of locking means 301, however, if locking means 301 and a food tray are both employed with carrier 211, locking means 301, by design, provides support to the bottom surface of the food tray (as seen in FIG. 31). Further, locking means 301 prevents food container 321 from sliding down a predetermined point along the length of handle portion 76. Finally, as seen in FIG. 28, locking means 301 can be designed to credit-card sized dimensions and also include a perforated hinge line so that customers may tear apart the locking means and use portions of the locking means as valuable coupons or other advertising vehicles. Therefore, companies may advertise their goods or services by using the locking means both as an advertising vehicle and as a means for offering merchandise discounts or giveaways (such as, for example, a money card, a phone card or similar smart card having a magnetic strip thereon which contains electronic information). Therefore, portions A and B illustrated in FIG. 28*a* can be imprinted with advertising media and be used as coupons or as a means for offering merchandise discounts.

Employing locking means 301 with carrier 211 is advantageous for several reasons. For example, a plurality of various-sized cups can be placed into carrier 211 on any uneven working surface, and when locking means 301 is employed, the overall horizontal stability of carrier 211 will be retained in any work place environment. Additionally, a plurality of drinking or food (such as popcorn) cups which are uneven in height can be placed into carrier 211 by using locking means 301 without fear that handle portion 76 will fall over, thereby potentially disturbing or knocking over other cups as the cups are loaded into the carrier.

Figure 27:
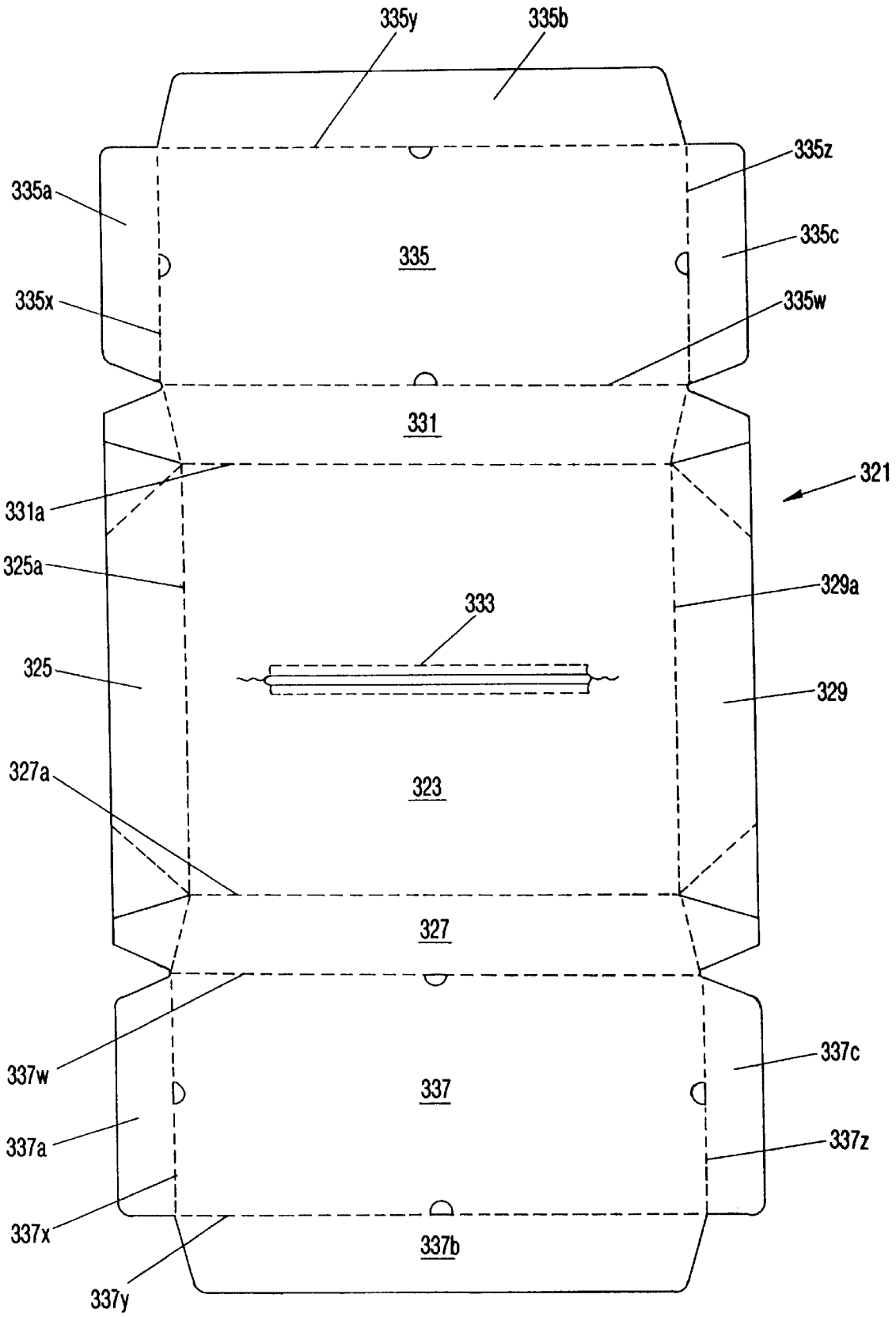
FIG. 27 illustrates a blank sheet from which the alternative tray of FIG. 23 is formed.

As best seen in FIG. 27, and more generally in FIGS. 23–26, optional auxiliary container 321 includes bottom 323, four side walls 325, 327, 329 and 331, and an elongated die cut slot 333. Attached to side walls 327 and 331 are lids 335 and 337. Attached to lid 335 are foldable panels 335*a*, 335*b* and 335*c*, all being foldable about perforated hinge lines 334*w*, 334*x*, 335*y* and 335*z*. Similarly, attached to lid

Figure 23:
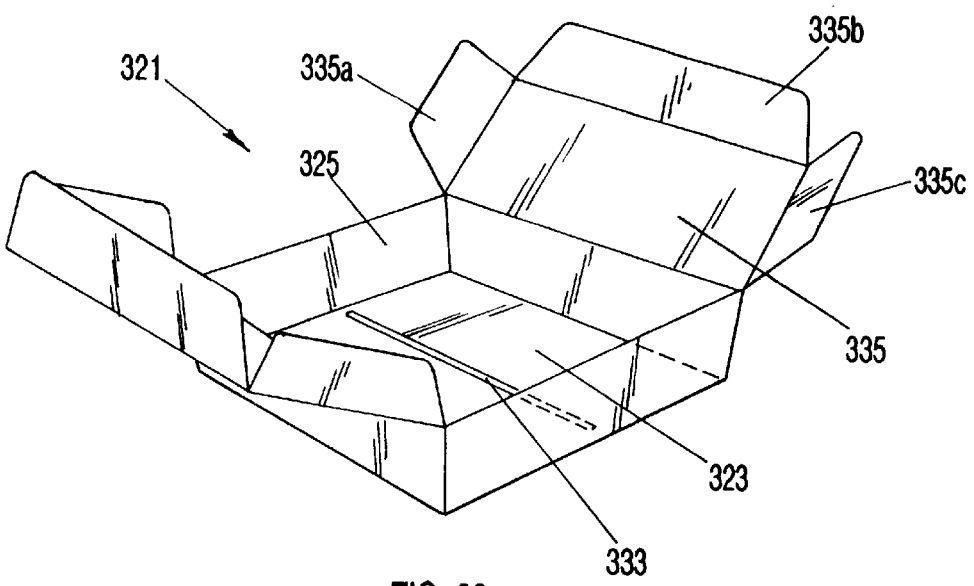
FIG. 23 is a side perspective view of an alternative tray adapted to be employed with the carrier of FIG. 31.
Figure 24:
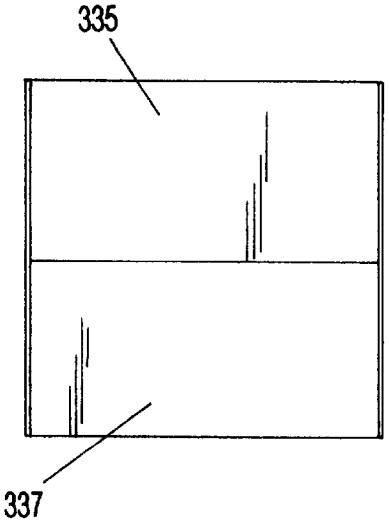
FIG. 24 is a top view of the alternative tray of FIG. 23, as seen when its cover, or lid, is in a closed position.
Figure 25:
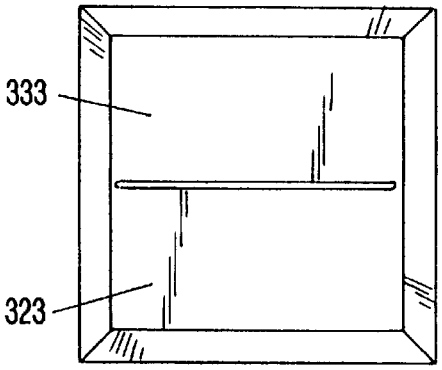
FIG. 25 is a bottom view of the alternative tray of FIG. 23.
Figure 26:
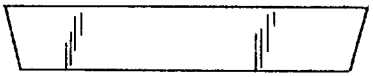
FIG. 26 is a side view of the alternative tray of FIG. 24.

337 are foldable panels 337*a*, 337*b* and 337*c*, all being foldable about perforated hinge lines 334*w*, 334*x*, 337*y* and 337*z*. Also, side wall 325 is attached to bottom 323 by foldable perforated hinge line 325*a*, side wall 327 is attached to bottom 323 by foldable perforated hinge line 327*a*, side wall 329 is attached to bottom 323 by foldable perforated hinge line 329*a* and side wall 331 is attached to bottom 323 by foldable perforated hinge line 331*a*. When auxiliary container 321 is folded about all perforated hinge lines as illustrated in FIG. 27 and glued as necessary, the resulting container (in an open position) is shown in FIG. 23 and in a closed position, is shown in FIG. 24. Container 321 may be formed of paperboard or other stiff sheet material of the same type as the material from which carrier 211 is formed.

There are two primary benefits of an auxiliary container such as illustrated in FIGS. 23–27. First, prior to the present invention, container manufacturers never placed a slot on the bottom of the container. Rather, conventional containers provided openings toward the top of the container to allow steam from food to escape the inner environment of the container. Indeed, the fast food industry would never have provided a slot on the bottom of container 321 because of the potential loss of integrity of the container bottom. However, when a bottom-slotted container is employed as discussed in the present invention, the container provides more stability and integrity in retaining food or other items. Second, no other container was ever employed with a carrier such as described in the present invention. Thus, when auxiliary container 321 is employed with carrier 211 and locking means 321 as shown in FIG. 31, handle portion 76 engages container slot 333 to thereby allow container 321 to sit upon locking means 301. In this fashion, both drinks and food items can easily be loaded into one system and simply carried away by the patron.

Whereas the drawings and accompanying description have shown and described the preferred embodiment of the present invention, it should be apparent to those skilled in the art that various changes may be made in the form of the invention without affecting the scope thereof. For instance, the support panel apertures may be made in different sizes to accept different size drinking cups. The entire carrier may itself be made in different sizes with differing numbers of cup-receiving apertures, so as to readily accept two, four, six or even eight cups.

I claim:

1. A carrier for transporting one or more food or drink containers, said carrier comprising:

(a) a handle portion of predetermined width and length, and having a pair of notches formed on opposite edges of the handle portion, the handle portion further including at least one slot formed therein substantially between the notches;

(b) a first panel, the first panel including at least a first opening therein and having a first upper surface;

(c) a second panel, the second panel including at least a second opening therein and having a second upper surface;

(d) means to connect the handle portion to both the first and the second panels between the first and the second upper surfaces, the connecting means being flexible to permit the handle portion to be moved between a position where the handle portion is perpendicular to the first and second upper surfaces and a position where the handle portion is substantially parallel with one of the first and second upper surfaces;

(e) means, connected to both the first and second panels, for limiting movement of the first panel towards the second panel when containers are placed in and carried by the first and second openings, the means for limiting movement including at least third and fourth openings therein, the third opening being in substantial alignment with the first opening, and the fourth opening being substantially aligned with the second opening, the first, the second, the third and the fourth openings being elliptical openings, each the elliptical opening having a major axis, the major axis of the first opening being substantially perpendicular to the major axis of the third opening, the major axis of the second opening being substantially perpendicular to the major axis of the fourth opening; and (f) a removable locking means, the locking means being adapted to engage one of the at least one of the handle portion slots in interlocking fashion to allow the locking means, and thus the handle portion, to be supported by a container when a container is loaded into the carrier and to retain the handle portion in an upright position.

2. The carrier for transporting one or more food or drink containers of claim 1 further including an auxiliary food tray, the tray comprising side wall portions and a bottom portion, the side walls all being integrally attached to the bottom portion, the bottom portion having a tray slot formed therein to receive said handle portion, the tray slot being substantially the same width and length as said handle portion.

3. The carrier for transporting one or more food or drink containers of claim 2 wherein the tray slot engages the handle portion notches for fixedly positioning the tray on said handle portion.

4. The carrier for transporting one or more food or drink containers of claim 2 wherein the locking means is a rigid key.

5. The carrier for transporting one or more food or drink containers of claim 4 wherein the key further includes a rectangular head and a rectangular body, the handle portion slot adapted to receive the rectangular body in interlocking fashion.

6. The carrier for transporting one or more food or drink containers of claim 4 wherein the key further includes a semicircular head and an elongated body, the handle portion slot adapted to receive the elongated body in interlocking fashion.

7. The carrier for transporting one or more food or drink containers of claim 4 wherein the key is imprinted with advertising media and offers for merchandise discounts.

8. The carrier for transporting one or more food or drink containers of claim 7 wherein the locking means further includes a magnetic strip placed thereon, the magnetic strip containing electronic information.

9. A combination drink and food container transport, the transport comprising a carrier and a coverable tray, the carrier further including a first panel having at least one opening therein, a second panel having at least one opening therein, an intermediary panel foldably attached between ends of the first panel and the second panel and having openings in registry with the first and second panel openings, and a handle portion foldably attached between opposite ends of the first and second panel, the handle portion having a given width and thickness and further including at least one slot formed therein at a predetermined position, the tray further including side walls foldably attached to a bottom portion, the bottom portion having a slot formed therein and sized in width and thickness to receive the handle portion, and a removable locking means, the locking means being adapted to engage one of the at least one of the handle portion slots in interlocking fashion.

10. The combination drink and food container transport of claim 9 wherein the handle portion further includes a handle cutout and a pair of notches formed on opposite edges of the handle portion.

11. The combination drink and food container transport of claim 10 wherein two of the tray side walls are foldably attached to two tray lids, the two tray lids being adapted to allow the tray to be in an open position or in a closed, covered position.

12. The combination drink and food container transport of claim 11 wherein the slot formed in the handle portion is substantially positioned between the handle portion notches.

13. The combination drink and food container transport of claim 10 further including at least one detachable advertising panel attached to the handle portion.

14. The combination drink and food container transport of claim 10 further including at least one detachable advertising panel attached to the handle portion, the advertising panel further including a handle cutout correspondingly positioned with the handle portion cutout.

15. The combination drink and food container transport of claim 9 wherein the opening in the first panel is elliptical, the opening in the second panel is elliptical, and the openings in the intermediary panel are elliptical and offset perpendicularly with respect to the openings in the first and second panels.

* * * * *